United States Patent [19]

Privon et al.

[11] 4,131,396

[45] Dec. 26, 1978

[54] HERMETIC COMPRESSOR LUBRICATION SYSTEM WITH TWO-STAGE OIL PUMP

[75] Inventors: George T. Privon; Andrew W. Paczuski, both of Bristol, Tenn.

[73] Assignee: Sundstrand Corporation, Rockford, Ill.

[21] Appl. No.: 785,712

[22] Filed: Apr. 7, 1977

[51] Int. Cl.[2] ..... F04B 17/00; F01M 1/00; F01M 9/00; F01M 1/10

[52] U.S. Cl. ..... 417/372; 417/902; 184/6.16; 184/6.18; 184/6.24

[58] Field of Search ..... 417/372, 902, 245; 184/6.16, 6.18, 6.24

[56] References Cited

U.S. PATENT DOCUMENTS

| | | | |
|---|---|---|---|
| 2,855,139 | 10/1958 | Weibel | 417/372 X |
| 2,963,113 | 12/1960 | Ayling | 417/372 X |
| 3,008,628 | 11/1961 | Benteis et al. | 417/372 |
| 3,162,360 | 12/1964 | Privon et al. | 417/372 |
| 3,248,044 | 4/1966 | Parker | 417/372 |
| 3,311,292 | 3/1967 | Connor | 417/372 X |
| 3,926,281 | 12/1975 | Hannibal | 184/6.16 |
| 3,947,153 | 3/1976 | Matthias | 417/372 X |

*Primary Examiner*—C. J. Husar
*Assistant Examiner*—R. E. Gluck
*Attorney, Agent, or Firm*—Ted E. Killingsworth; William R. Peoples; Michael B. McMurry

[57] ABSTRACT

A hermetic refrigerant compressor includes an electric motor mounted within a sealed housing with a crankshaft extending vertically from the motor to connect with a plurality of radially disposed compressor pistons. The lower end portion of the crankshaft extends into a sump of lubricant collected in the lower end of the housing and first and second stage pumping means are formed in the lower end of the housing to pump lubricant to upper and lower bearings which support the crankshaft within the housing. A vent communicates with the inlet to the first stage pumping means for venting flashed refrigerant gases from the system before the lubricant enters the first stage pumping means. In addition, a filter may be provided for continuously cleaning some of the lubricant discharged from the first stage pumping means without interfering with the flow of lubricant from the first stage pumping means to the second stage pumping means. Further still, means are provided for intermittent filtration of lubricant discharged from the second stage pumping means.

25 Claims, 4 Drawing Figures

HERMETIC COMPRESSOR LUBRICATION SYSTEM WITH TWO-STAGE OIL PUMP

BACKGROUND OF THE INVENTION

The present invention relates generally to a hermetic refrigerant compressor such as may be driven by an electric motor supported within a hermetically sealed housing. More particularly, the invention relates to a lubrication system for such compressor wherein advantage is taken of the rotation of a shaft driven by the motor for lubricating parts of the compressor. Typically, for a lubrication system of this type, the compressor motor is oriented so the driven shaft extends vertically downward with the lower end portion of the shaft being immersed in a sump of lubricant collected in the lower section of the housing. With the lower end portion of the shaft constructed as a pump impeller to form a lubricant pumping means, when the motor is running, lubricant may be pumped upwardly through the system to lubricate between the parts of the compressor which are moving relative to each other.

Prior art hermetic refrigerant compressor, such as those disclosed in U.S. Pat. No. 3,584,980 and U.S. Pat. No. 3,926,281, the lower end portion of the driven shaft may be adapted to function as a two-stage pump. One reason for using two-stage pumping is to develop sufficient flow and pressure in the discharged lubricant for lubricating the less accessible upper parts of the compressor. This is particularly important in a multiple-speed compressor which is powered by an electric motor that is adapted to be switched selectively between two-pole and four-pole operating modes according to the speed desired for operation of the compressor. With the motor operating in its two-pole mode, its speed is, of course, twice that of when operating in its four-pole mode. Accordingly, the quantity of lubricant and the pressure within the lubricant being pumped by the rotating shaft is substantially different for the two modes of operation.

Even with the increased flow and pressures provided by two-stage pumping, difficulty may be encountered in obtaining adequate lubrication of the support bearings for the motor. This is because some of the refrigerant used in the compressor is naturally absorbed in the lubricant and, as the lubricant is pumped through the system, the absorbed refrigerant tends to flash or boil out of the lubricant as lubricant pressure decreases and/or temperature increases. Undesirably, the flashed refrigerant gases may collect within the passages of the lubricating system, creating a pressure barrier to the adequate flow of lubricant to the working parts of the compressor. Moreover, as shown in the disclosures of the afore-mentioned patents, prior construction at the lower end portion of the driven shaft for two-stage pumping has been somewhat complicated.

SUMMARY OF THE INVENTION

The primary object of the present invention is to provide a lubricating system of the above general character which is simpler, less expensive to manufacture and more efficient in lubricating moving parts of the compressor than prior similar systems. A more detailed object is to achieve the foregoing in a lubricating system which utilizes a two-stage impeller pump and which is particularly adapted so as to avoid blockage of lubricant flow to critical moving parts such as might otherwise be caused by flashing refrigerant gases.

Still further, the invention resides in the simplified construction of a two-stage lubricating system, the two-stage pumping and the unique adaptation of a scheme for venting flashed refrigerant gases from the system.

Additionally, the invention resides in the unique construction and relationship of the inlets to the two pumping stages of the system and especially in the construction of the inlet to the first stage whereby the flashing of refrigerant gases from the lubricant is induced before the lubricant actually enters the first stage pumping means.

A further object is to provide a system which is adapted to avoid the accumulation of dirt particles in lubricant passages between moving parts of the compressor so as to thereby avoid the clogging of such passages and damage to moving parts as might otherwise be caused by inadequate flow of lubricant due to clogging. A more detailed object is to achieve this through the provision of a unique filtering arrangement particularly adapted to continuously filter lubricant flowing from the first stage of pumping, yet without interfering with such flow so that, should the filter become clogged, the moving parts of the compressor will not be starved of lubricant.

The invention also resides in the novel construction of the filtering arrangement so as to also filter lubricant from the second stage of pumping.

These and other objects and advantages of the present invention will become more apparent from the following detailed description when taken in conjunction with the accompanying drawings.

DETAILED DESCRIPTION OF PREFERRED EMBODIMENT

Figure 1:
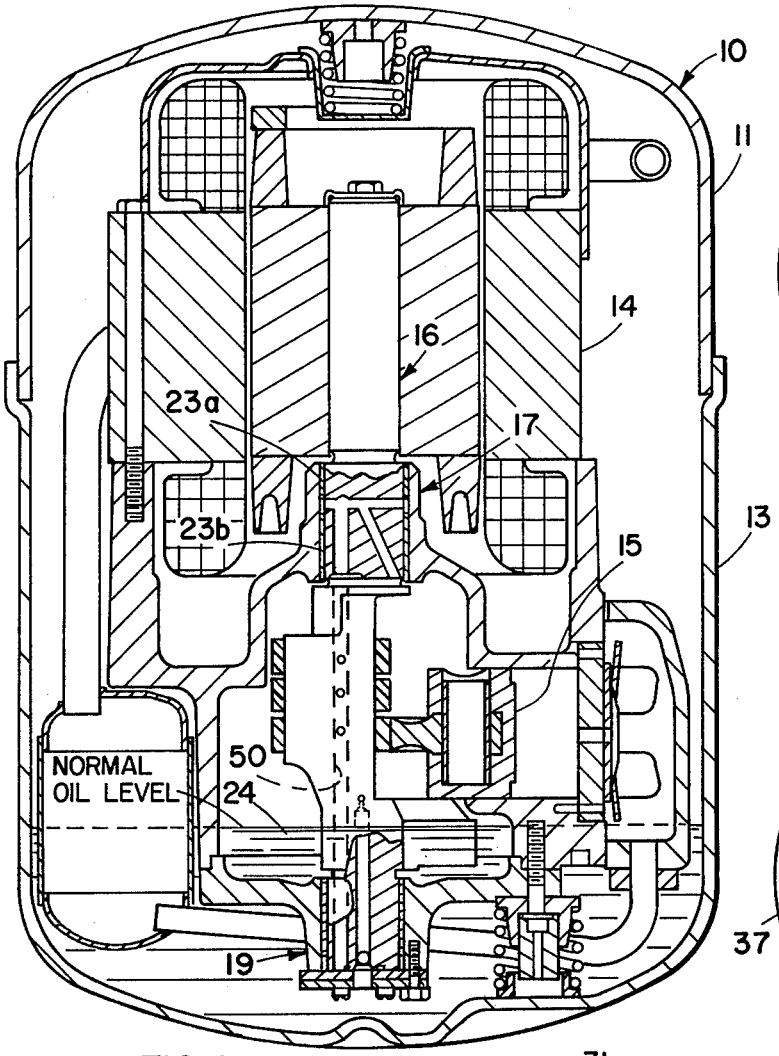
FIG. 1 is a cross-sectional view of a hermetic refrigerant compressor utilizing a lubrication system embodying the novel features of the present invention.

As shown in the drawings for purposes of illustration, the present invention is embodied in a lubrication system particularly suited for use in a hermetic refrigerant compressor 10. Herein, the compressor includes a housing having generally cylindrical upper and lower sections 11 and 13, respectively, and suitably mounted within the housing is an electric motor 14 which may be a single speed or two speed motor. Refrigerant gas is returned to the interior of the housing through an inlet (not shown) from the return pipes of a refrigeration system (not shown). To compress the refrigerant gases, a plurality of compressor pistons 15 are located beneath the motor and are drivingly connected to the motor by way of a driven shaft in the form of a crankshaft 16. Accordingly, as the crankshaft is rotated by the motor, the compressor pistons are reciprocated to draw the refrigerant gases from the interior of the housing, compress those gases and then discharge the compressed gases into the refrigeration system for cooling.

Supporting the crankshaft 16 laterally above and below the compressor pistons 15 are upper and lower bearing supports 17 and 19, respectively. In the lower support 19, a bearing sleeve 20 is telescoped into the support and receives the lower end portion 21 of the crankshaft 16 and, in the upper support, upper and lower sections 23*a* and 23*b* of a bearing sleeve telescopically receive an intermediate section of the crankshaft. To support the crankshaft 16 in an axial direction, a thrust plate 18 is suitably secured to the lower bearing support beneath the lower end 21*a* of the crankshaft. Sandwiched between the thrust plate and the lower end of the crankshaft is a thrust washer or bearing plate 22 which is rotatably engaged by the lower end of the shaft on one side and by the thrust plate on the other side.

In the operation of the exemplary hermetic refrigerant compressor 10, it is necessary to provide lubricant between the bearing surfaces of the lower bearing sleeve 20 and the lower end portion 21 of the shaft 16, between the bearing surfaces of the upper sleeve and the intermediate section of the crankshaft 16 and to other relatively moving parts of the compressor to avoid excessive wear between various parts of the compressor. A sump 24 of lubricant is provided in the lower section 13 of the housing with the lower end portion 21 of the crankshaft 16 extending into this sump. Herein, this end of the crankshaft is constructed in the form of a pump impeller operable to draw lubricant from the sump and to pump this lubricant through the lubrication system by taking advantage of the centrifugal forces created by the rotating shaft. When the motor is connected in its two-pole operating mode, the speed of the shaft 16 and the motor 14 is, of course, twice that of when the motor is operating in its four-pole mode. Because of this, the pressure and flow of lubricant through the lubricating system may be substantially greater at the high motor speed than when the motor is operating in its lower speed four-pole mode. In an attempt to assure that an adequate amount of lubricant is supplied to both the lower and upper bearing sleeves 20 and 23 regardless of the speed at which the motor is being operated, the lower end portion of the shaft has been constructed as a two-stage pump. The two-stage pump, while increasing the pressure and flow capacity of the lubricating system, generates refrigerant gas that is flashed from the lubricant during pumping. Under some conditions, these flashed refrigerant gases may collect within the lubricating system and inhibit the flow of lubricant through the system.

In accordance with the primary aspect of the present invention, the exemplary lubrication system is constructed in a particularly unique and simplified manner so as to avoid the problem of lubricant blockage due to collected refrigerant gases while also providing a less expensive system. For these purposes, first and second stage pumping means are associated with the lower end portion 21 of the shaft 16 and a vent 25 is provided within the shaft to communicate between the inlet for the first stage pumping means and the interior of the compressor housing above the level of lubricant in the sump 24. By virtue of this construction, the refrigerant gases which are flashed from the lubricant as it is drawn into the first stage pumping means are directed back into the interior of the compressor housing without flowing into the lubrication system, thereby avoiding the problem of refrigerant gases collecting in the system to block the flow of lubricant through the system.

In the present instance, the first stage pumping means includes a diametrical bore 26 which is formed in the lower end portion 21 of the crankshaft 16 and which is spaced upwardly from the end face 21*a* of the crankshaft to extend completely through the shaft. An axial inlet 27 to the first stage pumping means is defined by axial openings 29 and 30 which are formed in the thrust plate 18 and the bearing plate 22, respectively. Thus, as the crankshaft rotates, lubricant from the sump 24 is drawn upwardly through the inlet 27 and in an axial direction relative to the crankshaft 16 before being slung radially outward through the bore 26.

Preferably, but not necessarily, the diameter of the opening 30 in the bearing plate 22 is smaller than the diameter of the opening 29 in the thrust plate 18 thereby providing a restriction within the inlet to the first pumping means. As a result, the lubricant flowing through the inlet is subjected to an abrupt and substantial drop in pressure prior to entering the bore 26. Because of the drop in pressure caused by the restriction, refrigerant gases in the lubricant tend to flash more readily from the lubricant before the lubricant enters the bore 26.

Figure 2:
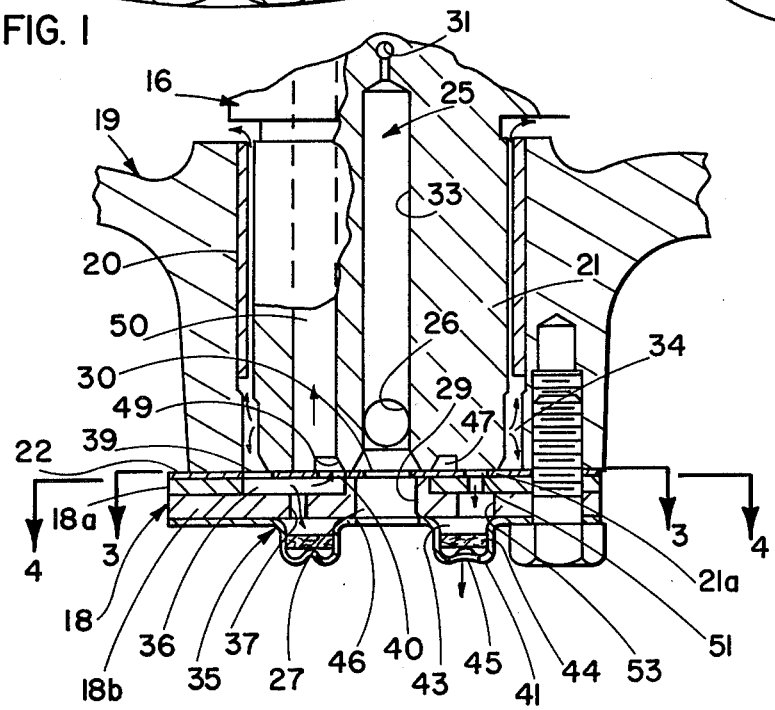
FIG. 2 is an enlarged cross-sectional view of a portion of the lower end of the driven shaft of the compressor motor, particularly illustrating a two-stage pump impeller of the exemplary lubricating system.

To vent these gases from the system, the vent 25 communicates with the inlet 27 on the downstream side of the opening 30 and thus provides a passage by way of which the flashed refrigerant gases may escape. As shown in FIG. 2, the vent 25 more particularly includes a bore 33 extending axially upward from an intersection with the diametrical bore 26. Preferably, the upper end of the axial bore 33 is located above the lower bearing support 19, and a small diametrical passage 31 extends through the crankshaft 16, intersecting with the upper end of the vent bore 30 to provide an escape route for venting refrigerant gases into the interior of the housing from above the lower support 19 and above normal oil level. Thus, the gases are kept from collecting in the inlet area of the first stage pumping means to interfere with the flow of lubricant through the diametrical bore 26.

Some of the lubricant discharged from the first stage pumping means serves to lubricate the lower bearing sleeve 20 and the crankshaft 16. More specifically, the lubricant is discharged from opposite ends of the diammetrical bore 26 and flows into an annular chamber 34 which is defined by the space between the lower bearing support 19 and the lower end portion 21 of the shaft 16 beneath the lower end of the bearing sleeve 20. Some of the lubricant discharged from the first stage pumping means flos upwardly toward the bearing sleeve 20 for lubrication of the surfaces between the bearing sleeve and the crankshaft 16. The remaining portion of the lubricant is directed downwardly toward the bearing plate 22. Advantageously, this particular construction discourages dirt from clogging between the bearing sleeve 20 and the crankshaft 16 because gravity tends to cause the heavier particles of dirt to flow with the lubricant downwardly rather than upwardly between the bearing sleeve 20 and the shaft 16. Thus, the lubricant for the lower bearing support is kept relatively clean.

Figure 3:
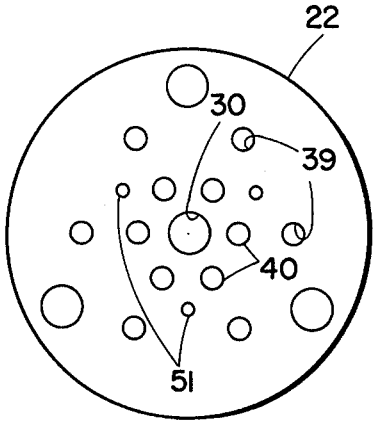
FIGS. 3 and 4 are enlarged views taken substantially along lines 3—3 and 4—4 of FIG. 2.
Figure 4:
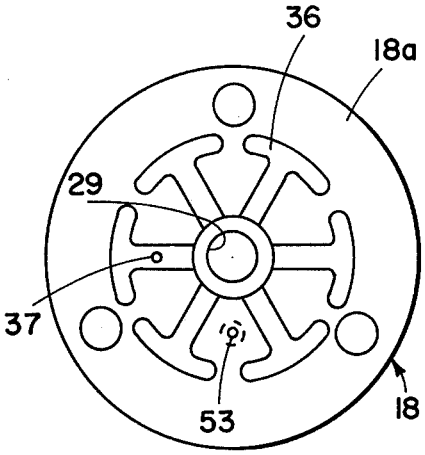

The downwardly flowing lubricant from the first stage pumping means passes through the bearing plate 22 into passages 36 leading to the second stage pumping means to provide lubricant for the second stage pumping means. As shown in FIGS. 2 and 4, the passages 36 are defined between the bearing plate 22 and the thrust plate 18 so as to extend between the annular chamber 34 and an inlet to the second stage pumping means. More particularly, a series of six angularly spaced apertures 39 (see FIG. 3) are formed in the bearing plate 22 and are positioned in axial alignment with the lower end of the chamber 34 for passage of lubricant from the chamber 34 into the passages 36. Advantageously, the latter are defined by a series of six angularly spaced T-shaped slots 36 formed through the upper section 18*a* of the thrust plate 18. Spaced radially inward of the first series of angularly spaced apertures 39 in the bearing plate 22 is a second series of six angularly spaced apertures 40 axially aligned with the radially inward ends of the T-shaped slots 36 of the thrust plate 18 and serving as the inlet to the second stage pumping means. As shown in FIG. 3, the apertues 39 and 40 are radially aligned with each other so that each radially aligned pair of apertures 39 and 40 are located at opposite ends of one of the T-shaped slots 36.

In accordance with another important aspect of the present invention, the exemplary lubrication system may include a filter 35 adapted for continuous filtration of lubricant flowing from the first stage pumping means toward the second stage pumping means without interfering with the flow of lubricant to the second stage pumping means. For this purpose, a by-pass passage 37 is connected between one of the passages 36 and the filter 35. During operation of the compressor, some of the lubricant flowing through the passage 36 necessarily flows through the by-pass passage 37 into the filter 35 while the remaining portion of the lubricant passes on toward the second stage pumping means. By virtue of this construction, in the event that the filter becomes clogged during operation of the compressor, the second stage pumping means is kept from being starved of lubricant.

As shown in FIG. 2, the filter 35 includes an end cover 41 attached to the underside of the lower section 18*b* of the thrust plate 18. A central opening 46 in the end cover admits lubricant to the inlet 27 of the first stage pumping means and an annular filter chamber 43 is formed in the end cover concentric with the central axis of the crankshaft 16. An outlet 45 in the filtering chamber communicates with the sump 24 so that the filtered lubricant is discharged back into the sump. Contained within the filter chamber is an annular filtering element 44 and the by-pass passage 37 opens into the filter chamber above the filtering element 44. Accordingly, the high pressure discharge lubricant from the passage 36 flows into the annular filter chamber 43 and is forced through the element 44 to the outlet 45 of the chamber so that the filtered lubricant is discharged back into the sump 24.

As previously mentioned, in providing lubricant for the second stage pumping means, the apertures 40 define the inlet to the second stage pumping means, which, herein, includes an annular groove 47 formed in the end face 21*a* of the crankshaft 16. In the present instance, the apertures 40 are spaced radially outward from the inlet 27 to the first stage pumping means. The groove 47 is formed concentric with the central axis of the shaft and, in part, is defined by a radially inward wall 49 which has an inverted generally frustoconical shape. This upwardly and outwardly slanting wall 49 serves as a portion of the impeller of the second stage pumping means so that, as the crankshaft 16 is rotated, lubricant flowing upwardly through the inlet apertures 40 is slung radially outward within the groove 47, thereby increasing the pressure of the lubricant. Intersecting with the groove 47 is a second bore 50 extending in a generally axial direction from the lower end portion of the shaft 16 upwardly toward the upper bearing support 17. This bore serves as the discharge conduit 50 for the lubricant expelled from the second stage pumping means for supplying lubricant to the bearing surfaces of the upper support sleeve sections 23*a* and 23*b* and the crankshaft 16.

Preferably, the diameter of the conduit 50 is greater than the diameter of any of the apertures 40. Accordingly, dirt particles in the discharged lubricant from the second stage pumping means tend to accumulate on top of the bearing plate 22 within the conduit 50. In accordance with another unique feature of the present invention, means are provided for removing the collected dirt particles from the lower end portion of the conduit 50. To this end, the bearing plate 22 includes a port 51 formed therethrough in axial alignment with another port 53 formed through the thrust plate 18. Moreover, the port 51 is spaced radially outward from the central axis of the shaft 16 so as to register with a portion of the conduit 50 with each revolution of the crankshaft 16. Thus, collected dirt particles and lubricant may be discharged intermittently from the second stage pumping means through the bearing and thrust plates 22 and 18. The ports 51 and 53 also are aligned axially with the filter chamber 43 so that the lubricant and dirt particles discharged from the second stage pumping means may be directed through to the filter 41. Thus, discharged lubricant from the second stage pumping means may be intermittently filtered during operation of the compressor 10.

As shown in FIG. 3, the bearing plate 22 is provided with three angularly spaced ports 51 for ease in assembly of the bearing plate with the thrust plate 18. When the bearing plate and thrust plate are assembled, only one of the ports 51 is aligned with the port 53 in the thrust plate. In this way, it is assured that lubricant will be able to flow through the bearing plate and into the port 53 of the thrust plate regardless of the relative angular orientations of the bearing and thrust plates.

In view of the foregoing, it will be appreciated that the present invention brings to the art a new and improved lubrication system particularly adapted for use in a hermetic refrigerant compressor 10. In particular, the lubrication system is provided with first and second stage pumping means and a vent 25 which communicates with the inlet 27 of the first stage pumping means to assure that refrigerant gases flashing from the lubricant drawn from the sump 24 are kept from blocking the flow of lubricant through the first stage pumping means. Optionally, the filter 35 communicates with one of the passages 36 through which discharged lubricant from the first stage pumping means flows to the second stage pumping means. Advantageously, the filter 35 communicates with the passage 36 through a by-pass passage 37 so that the filter avoids interfering with the flow of lubrucant from the first stage pumping means to the second stage pumping means while still providing for continuous filtration of lubricant discharged from the first stage pumping means. Still further, intermittent filtration of lubricant discharged from the second stage pumping means is provided in the lubrication system as the discharge conduit from the second stage pumping means registers with the aligned ports 51 and 53 of the bearing plate and thrust plate, respectively, so that a portion of the second stage discharge lubricant is directed to the filter 35.

We claim:

1. In a hermetic compressor including, a hermetically sealed housing, an electric motor mounted within said housing, a driven shaft connected to and depending from said motor and having a lower end portion immersed in a sump of lubricant in the housing, bearing surfaces supporting said shaft within said housing, means supported within said housing and drivingly connected with said shaft to be driven by said motor for compressing refrigerant gases from within said housing, the improvement in said compressor comprising, a lubrication system for supplying lubricant to said bearing surfaces including, first and second stage pumps located within said lower end portion of said shaft, an inlet to said first stage pump communicating with the sump, said inlet for said first stage pump is coincident with the rotational axis of said shaft, and a vent for refrigerant gases communicating directly with said inlet and extending through said shaft concentrically along the axis thereof for at least for some distance above said first stage pump for directing flashed refrigerant gases away from said first stage and back to the interior of said housing above said sump.

2. A lubrication system for a hermetic refrigerant compressor as defined by claim 1 including an inlet to said second stage pump located radially outward of said inlet to said first stage pump.

3. In a hermetic refrigerant compressor including, a hermetically sealed housing, an electric motor mounted within said housing, a driven shaft connected to and depending from said motor and having a lower end portion immersed in a sump of lubricant in the housing, bearing surfaces supporting said shaft within said housing, means supported within said housing and drivingly connected with said shaft to be driven by said motor for compressing refrigerant gases from within said housing, the improvement in said compressor comprising, a lubrication system for supplying lubricant to said bearing surfaces including, first and second stage pumps located within said lower end portion of said shaft, an inlet to said first stage pump extending along the axis of said shaft and communicating with the sump, an inlet to said second stage pump communicating with said first stage pump and being spaced radially outward from said first stage inlet, and a vent for refrigerant gases communicating with said first stage inlet and extending through said shaft above said first stage pump, said vent including a bore intersecting said first stage inlet substantially at the central axis of said shaft for directing flashed refrigerant gases away from said first stage and back to the interior of said housing above said sump before lubricant passes through said first stage pump.

4. A lubrication system for a hermetic refrigerant compressor as defined by claim 3 including a restriction in said first stage inlet for creating a pressure drop in the lubricant flowing from said sump and through said first stage inlet to help induce flashing of refrigerant from said lubricant.

5. A lubrication system for a hermetic refrigerant compressor as defined by claim 4 including a thrust plate positioned adjacent the lower end of said shaft, and a bearing plate sandwiched between said thrust plate and the lower end of said shaft, said inlet to said first stage pump being defined by axially aligned first and second central openings formed in said bearing and thrust plates, respectively, said openings being concentric with the axis of said shaft, said first opening being smaller in diameter than said second opening and thereby defining said restriction.

6. A lubrication system for a hermetic refrigerant compressor as defined by claim 3, wherein said vent includes an axial bore formed in said shaft, said bore having one end opening from the lower end of said shaft and an upper end positioned above said first stage pump, and a passage extending away from the upper end of said bore, and opening into the interior of said housing above the level of said sump.

7. A lubrication system for a hermetic refrigerant compressor as defined by claim 6 including a lower bearing support mounted within said housing and connected to at least one of said bearing surfaces, said upper end portion of said bore being positioned above said lower bearing support, and above normal oil level.

8. A lubrication system for a hermetic refrigerant compressor as defined by claim 7 wherein said passage extends generally radially from the upper end of said bore opening into said housing above said lower bearing support, and normal oil level.

9. A lubrication system for a hermetic refrigerant compressor as defined by claim 3 wherein said first stage pump includes one or more radial bores extending completely through said shaft above the lower end thereof, said radial bore intersecting with said vent adjacent the rotational axis of said shaft so that, as said shaft is rotated, lubricant is slung radially outward through said radial bore and flashed refrigerant gases flow upwardly through said vent and into the housing above the level of the lubricant sump.

10. In a hermetic refrigerant compressor including, a hermetically sealed housing, an electric motor mounted within said housing, a driven shaft connected to and depending from said motor to extend into a sump of lubricant in the housing, bearing surfaces supporting said shaft within said housing, means supported within said housing and drivingly connected with said shaft to be drive by said motor for compressing refrigerant gases from within said housing, the improvement in said compressor comprising, a lubrication system for supplying lubricant to said bearing surfaces including, first and second stage pumping means connected to the lower end portion of said shaft, an inlet to said first stage pumping means extending along the axis of said shaft and communicating with the sump, an inlet to said second stage pumping means communicating with said first stage pumping means and being spaced radially outward from said first stage inlet, a vent for refrigerant gases communicating with said first stage inlet and extending through said shaft above said first stage pumping means for directing flashed refrigerant gases away from said first stage and back to the interior of said housing above said sump, said first stage pumping means including one or more radial bores extending completely through said shaft above the lower end thereof, said radial bore intersecting with said vent adjacent the rotational axis of said shaft so that, as said shaft is rotated, lubricant is slung radially outward through said radial bore and flashed refrigerant gases flow upwardly through said vent and into the housing above the level of the lubricant sump, and upper and lower bearing supports in said housing and containing said bearing surfaces, an annular chamber located between said lower bearing support and said shaft and communicating with the radially outward ends of said radial bore to receive the lubricant slung radially outward through said radial bore, passage means communicating between said chamber and said second stage pumping means for supplying lubricant to said second stage pumping means, a by-pass opening between said passage means and said sump for continuous communication of lubricant discharged from said first stage pumping means with said sump to remove dirt.

11. A lubrication system for a hermetic refrigerant compressor as defined by claim 10 including an end cover with an annular filter chamber disposed below the lower end of said shaft, a filtering element contained within said filter chamber and positioned so lubricant from said by-pass opening necessarily passes through said element upon flowing toward said sump.

12. A lubrication system for a hermetic refrigerant compressor as defined by claim 10 wherein said second stage pumping means includes an annular groove formed in the lower end of said shaft, said groove having a radially inward wall of an inverted, generally frustoconical shape, said second stage inlet communicating said second stage pumping means with said passage means, and a discharge conduit leading away from said second stage pumping means and toward said upper bearing surfaces.

13. A lubrication system for a hermetic refrigerant compressor as defined by claim 12 wherein said discharge conduit is located within said shaft, is spaced radially outward from said vent bore and extends upwardly in a generally axial direction.

14. A lubrication system for a hermetic refrigerant compressor as defined by claim 10 including means for discharging lubricant from said second stage pumping means to said sump to remove dirt.

15. A lubrication system for a hermetic refrigerant compressor as defined by claim 14 wherein said means for discharging lubricant from said second stage pumping means includes port means adapted for intermittent communication of the lubricant discharged from said second stage pumping means to said sump.

16. A lubrication system for a hermetic refrigerant compressor as defined by claim 15 including a thrust plate positioned adjacent the lower end of said shaft, and a bearing plate sandwiched between said thrust plate and the lower end of said shaft, said passage means including a first series of angularly spaced apertures formed in said bearing plate in axial alignment with said annular chamber, a plurality of grooves formed in the upwardly directed face of said thrust plate and extending in a generally radial direction inwardly from communication with said apertures toward said inlet to said second stage pumping means, a second series of angularly spaced apertures formed in said bearing plate for lubricant to communicate between the radially inward ends of said radial grooves and the inlet to said second stage pumping means.

17. A lubrication system for a hermetic refrigerant compressor as defined by claim 16 wherein said by-pass opening is formed in at least one of said radial grooves.

18. A lubrication system for a hermetic refrigerant compressor as defined by claim 16 wherein said port means comprises axially aligned first and second ports formed through said bearing plate and said thrust plate to communicate with said sump, said ports being located in said bearing plate and thrust plate between adjacent radial grooves and radially outward of said annular groove for intermittent communication with lubricant discharged from said second stage pumping means.

19. In a hermetic refrigerant compressor including, a hermetically sealed housing having upper and lower sections for confining refrigerant gases therewithin, an electric motor mounted within the upper section of said housing, a driven shaft connected to and depending from said motor into said lower section, a sump of lubricant in the lower section and receiving the lower end portion of said shaft, bearing means in said housing supporting said shaft, means supported within said housing and drivingly connected with said shaft to be driven by said motor for compressing said refrigerant gases, the improvement in said compressor comprising, a lubrication system for supplying lubricant to said bearing means including, first stage pumping means including a radial bore extending through said shaft above the lower end thereof, an axial inlet to said first stage pumping means communicating between said sump and said radial bore, second stage pumping means connected to the lower end portion of said shaft, an inlet to said second stage pumping means spaced radially outward of said inlet to said first stage pumping means, passage means communicating the outer end of said radial bore with the inlet to the second stage pumping means, and a by-pass opening between said passage means and said sump for continuous discharge of lubricant from said first stage pumping means to said sump.

20. A lubrication system for a hermetic refrigerant compressor as defined by claim 19 including means for intermittently discharging lubricant from the second stage pumping means to the sump.

21. In a hermetic refrigerant compressor including, a hermetically sealed housing having upper and lower sections for confining refrigerant gases therewithin, an electric motor mounted within the upper section of said housing, a driven shaft connected to and depending from said motor into said lower section, a sump of lubricant in the lower section and receiving the lower end portion of said shaft, upper and lower bearing supports in said housing and including bearing surfaces supporting said shaft within said housing, means supported within said housing and drivingly connected with said shaft to be driven by said motor for compressing said refrigerant gases, the improvement in said compressor comprising, a lubrication system for supplying lubricant to said bearing surfaces including, first and second stage pumping means connected to the lower end portion of said shaft, an inlet to said first stage pumping means communicating with said sump, an inlet to said second stage pumping means spaced radially outward of said inlet to said first stage pumping means, a vent for refrigerant gases communicating with said first stage inlet and extending through said shaft above said first stage pumping means for directing flashed refrigerant gases away from said first stage inlet and back to the interior of said housing above said sump, passage means communicating between said first and second stage pumping means, a filter supported within said housing adjacent said passage means and continuously communicating therewith without interfering with the flow of lubricant through said passage means, and an outlet from said filter for communicating lubricant back to said sump.

22. A lubrication system for a hermetic refrigerant compressor as defined by claim 21 including means for filtering lubricant from said second stage pumping means.

23. A lubrication system for a hermetic refrigerant compressor as defined by claim 22 wherein said means for filtering lubricant from said second stage pumping means includes port means adapted for intermittent communication of the lubricant discharged from said second stage pumping means to said filter.

24. A lubrication system for a hermetic refrigerant compressor as defined by claim 23 including a thrust plate positioned adjacent the lower end of said shaft, and a bearing plate sandwiched between said thrust plate and the lower end of said shaft, said passage means including a first series of angularly spaced apertures formed in said bearing plate in axial alignment with said annular chamber, a plurality of grooves formed in the upwardly directed face of said thrust plate and extending in a generally radial direction inwardly from communication with said apertures toward the inlet to said second stage pumping means, a second series of angularly spaced apertures formed in said bearing plate for fluid communication between the radially inward ends of said radial grooves and defining the inlet to said second stage pumping means.

25. In a hermetic refrigerant compressor including, a hermetically sealed housing having upper and lower sections for confining refrigerant gases therewithin, an electric motor mounted within the upper section of said housing, a driven shaft connected to and depending from said motor into said lower section, a sump of lubricant in the lower section and receiving the lower end portion of said shaft, upper and lower bearing supports in said housing and including bearing surfaces supporting said shaft within said housing, means supported within said housing and drivingly connected with said shaft to be driven by said motor for compressing said refrigerant gases, a thrust plate positioned adjacent the lower end of said shaft, a bearing plate sandwiched between said thrust plate and the lower end of said shaft, the improvement in said compressor comprising, a lubrication system for supplying lubricant to said bearing surfaces including first and second stage pumping means with said first stage pumping means having a radial bore extending through said shaft above the lower end thereof, an axial inlet to said first stage pumping means communicating between said sump and said radial bore, said axial inlet being defined by first and second central openings in said bearing and thrust plates, respectively, said first opening being smaller in diameter than said second opening so as to define a restriction in said inlet for creating a pressure drop in the lubricant flowing from said sump and through said inlet so as to help induce flashing of refrigerant gases from said lubricant, a vent for refrigerant gases including an axial bore in said shaft intersecting with said radial bore and extending upwardly from said first stage inlet to communicate with the interior of said housing above the level of said sump so that, as said shaft is rotated, lubricant is slung radially outward through said radial bore while flashed refrigerant gases within said first stage inlet flow upwardly through said axial bore and are vented into said housing, an annular chamber located between said lower bearing support and said shaft and communicating with the radially outward ends of said radial bore to receive the lubricant slung radially outward through said radial bore, a first series of angularly spaced apertures formed in said bearing plate in axial alignment with said annular chamber, a plurality of grooves formed in the upwardly directed face of said thrust plate and extending in a generally radial direction inwardly from communication with said apertures toward said second stage pumping means, an end cover connected to said thrust plate opposite said bearing plate, an annular filter chamber formed in said end cover, a filtering element contained within said chamber, a by-pass opening in said thrust plate communicating between one of said radial grooves and said filter chamber, an outlet from said chamber for communicating filtered lubricant from said chamber back to said sump, said second state pumping means including, an annular groove formed in the lower end of said shaft, said annular groove having a radially inward wall of an inverted, generally frustoconical shape, inlet means to said second stage pumping means comprising a second series of angularly spaced apertures formed in said bearing plate and spaced radially outward of said first stage inlet, for communicating lubricant from the radially inward ends of said radial grooves to said annular groove, a discharge conduit located within said shaft and extending upwardly away from said annular groove in a generally axial direction toward said upper bearing surfaces, and means for filtering lubricant discharged from said second stage pumping means including axially aligned first and second ports formed through said bearing and thrust plates, respectively, to communicate with said filter chamber, said ports being located in said bearing and thrust plates between said radial grooves radially outward of said annular groove for intermittent communication with lubricant flowing into said discharge conduit.

* * * * *